United States Patent [19]

Dolan

[11] 4,338,789

[45] Jul. 13, 1982

[54] METHOD OF VARYING TURBINE OUTPUT OF A SUPERCRITICAL-PRESSURE STEAM GENERATOR-TURBINE INSTALLATION

[76] Inventor: John E. Dolan, 171 Druid Ave., Dumont, N.J. 07628

[21] Appl. No.: 117,803

[22] Filed: Feb. 1, 1980

[51] Int. Cl.[3] ..... F01K 3/00

[52] U.S. Cl. ..... 60/652; 60/467

[58] Field of Search ..... 60/646, 647, 667, 665, 60/652; 122/406 ST

[56] References Cited

U.S. PATENT DOCUMENTS 3,262,431 7/1966 Hanzalek ..... 122/406 ST 4,241,585 12/1980 Gorzegno ..... 60/646

FOREIGN PATENT DOCUMENTS 247186 11/1926 United Kingdom ..... 60/647

*Primary Examiner*—Allen M. Ostrager

*Assistant Examiner*—Stephen F. Husar

*Attorney, Agent, or Firm*—Pennie & Edmonds

[57] ABSTRACT

A method of varying turbine output from approximately 85% rated load down to approximately 65% rated output or alternatively from 100% down to approximately 85% where the turbine forms part of a supercritical installation having a steam generator for generating steam to a predetermined amount in excess of critical pressure. The installation includes a feed water pump or maintaining pressures in the steam generator to the predetermined amount in excess of critical pressure, a division valve and a turbine control valve. Output is varied by maintaining the control valve in a fully or partially open position, the division valve in a fully open position and varying the delivery pressure of the feed water pump from the predetermined supercritical pressure to a pressure slightly above critical.

7 Claims, 5 Drawing Figures

Principal Steam Temperatures

Typical Heat Rate Trends

METHOD OF VARYING TURBINE OUTPUT OF A SUPERCRITICAL-PRESSURE STEAM GENERATOR-TURBINE INSTALLATION

FIELD OF THE INVENTION

The invention relates to a method of varying turbine output in a steam power plant with a supercritical steam generator-turbine installation.

BACKGROUND OF THE INVENTION

Various methods for controlling the output of steam turbines have been utilized in the past where the steam turbine forms part of a power installation including a steam generator for generating steam pressure and a superheater positioned between the steam generator and the turbine. The turbine itself is usually furnished with one or more control valves for varying the amount of steam supplied to the turbine to control its output.

Among the methods of controlling turbine output in subcritical steam pressure installations have been:

(1) constant or fixed throttle pressure-sequential valve operation in which the active nozzle area in the first stage of the turbine is varied by sequential operation of control valves to control flow of steam to the turbine;

(2) throttling control-single point valve operation in which all of the control valves are operated simultaneously and turbine output is varied by controlling the amount of throttling across the valves in order to control the flow of steam to the turbine;

(3) sliding pressure operation in which all the control valves are held in a fixed position and the throttle and nozzle inlet pressure are varied by varying the steam generator outlet pressure; and (4) hybrid operation which combines methods (1) and (3) or (2) and (3) at different ranges of turbine output.

Each method has its advantages and disadvantages when applied to commercial installations and their uses are dependent in part on steam generator and steam turbine design.

While the above methods of operation are applicable for use in subcritical installations, they may not entirely be used in supercritical installations utilizing steam pressures in excess of the critical pressure of steam, which is 3208.2 p.s.i. This is due in part to steam generator design considerations. In subcritical installations, sliding pressure operation is achieved by varying the firing rate of the steam generator which in turn varies the pressure of the steam delivered to the turbine. This method is not feasible for use in all supercritical operations because the pressure in the supercritical steam generators commonly used in the United States is never allowed to fall below the critical pressure whenever the steam generator is being fired.

It is therefore an object of my invention to provide for a method of varying turbine output in a supercritical steam generator-turbine installation which includes a sliding pressure control step over a portion of the range of turbine output whereby (1) temperature change and consequential thermal stresses imparted to the high pressure turbine may be minimized and whereby (2) net heat rate may be improved in lower load ranges of operation. The latter advantage can result in substantial fuel savings in the operation of a steam power plant.

DESCRIPTION OF THE INVENTION

Broadly a method according to the invention for varying turbine output is applicable for use in an installation having a steam generator for generating steam, a feed water pump for maintaining pressure in the steam generator to a predetermined amount in excess of the critical pressure, a superheater, a pressure reducing division valve or apparatus located between the steam generator and the superheater and a control valve associated with the turbine for regulating entry of steam to the turbine. The operating steps include setting the turbine control valve to a predetermined position, maintaining the division valve in a fully open position and varying the rate of delivery of the feed water pump in order to vary steam pressure in the steam generator within a range, the high pressure point of which is at a predetermined amount in excess of the critical pressure and the low pressure point of which is slightly above the critical pressure.

In one embodiment of the invention, the control valve is partially opened at approximately 85% of rated output and fully opened at 100% rated output to vary turbine output in the range of 85%–100% of rated output. Variation of the output in the range of approximately 65%–85% of rated output is achieved by varying the rate of delivery of the feed water pump from the point at which it produces steam pressure at the predetermined amount in excess of critical pressure at approximately 85% of rated capacity down to the point where the steam pressure is slightly in excess of critical pressure at approximately 65% of rated capacity. Turbine output in the range of approximately 65% of rated output down to 0% output is achieved by varying the opening of the division valve from the fully open position at approximately 65% rated output to the fully closed position at 0% rated output.

In a further embodiment of the invention, the control valve is maintained fully opened and turbine output in the range of 100% rated output down to approximately 65% rated output is achieved by varying the delivery rate of the feed water pump from the point at which it produces steam pressure at the predetermined amount in excess of critical pressure at 100% rated output down to the point where it produces steam pressure slightly in excess of critical pressure at approximately 65% of rated output. Variation of output in the range of approximately 65% rated output down to 0% rated output is accomplished by varying the opening of the division valve.

In a still further embodiment of the invention, the control valve is maintained fully open and turbine output is varied in the range of 100% of rated output down to approximately 85% of rated output by varying the delivery rate of the feed water pump from the point at which it produces steam pressure at the predetermined amount in excess of critical pressure at 100% rated output down to the point where it produces steam slightly in excess of critical pressure at approximately 85% of rated output. Turbine output in the range of 85% of rated output down to 0% of rated output is varied by varying the opening of the division valve from the fully opened position at approximately 85% of rated output to the fully closed position at 0% of rated output.

Preferably the components are designed for operating at a predetermined amount of pressure in excess of the critical pressure such that variance of turbine output due to varying feed water pump pressure may occur between the said predetermined pressure down to a point sufficiently above the critical pressure. The sufficiency above the critical pressure is determined by the steam generator design.

BEST MODE FOR CARRYING OUT THE INVENTION

Figure 1:
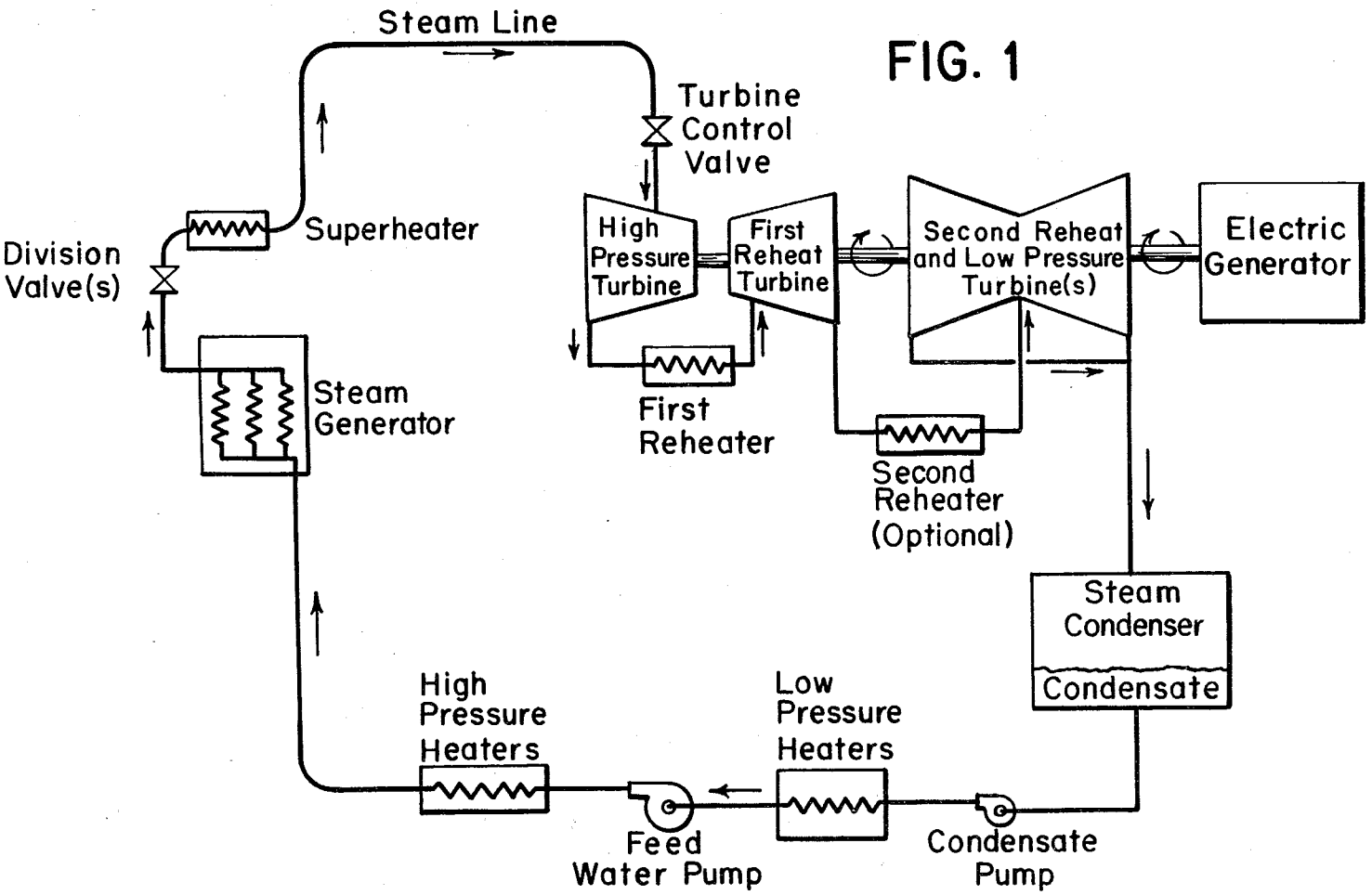
FIG. 1 is a flow diagram of a typical supercritical steam power installation and to which a method of varying turbine output according to the invention is applicable.

Referring to FIG. 1, there is illustrated a flow diagram of a typical supercritical steam generator-turbine installation. As shown, steam is generated in the steam generator and then passes through one or more division valves and on through a superheater. The steam then passes through a steam line to a turbine control valve which controls entry of steam into the first stage of a high pressure turbine. While only one control valve is shown, a plurality of valves may be used as previously explained with method (1) as pertains to a subcritical installation.

The steam then passes from the high pressure turbine through a first reheater into a first reheat turbine. The steam may then pass from the first reheat turbine through a second reheater into the entry sides of a second reheat turbine and then on to low pressure turbines. The high pressure turbine, the first reheat turbine and second reheat and low pressure turbines are all connected to one or two electric generators depending on the compounding of the turbines. The use of a second reheater is optional and, if desired, steam could flow directly from the first reheat turbine to the low pressure turbine.

Steam passes from the low pressure turbines to a steam condenser. The condensate formed in the condenser is pumped by means of a condensate pump through low pressure condensate heaters to the entry side of a feed water pump. The feed water pump then pumps feed water through high pressure feed water heaters and into the steam generator. The feed water pump maintains pressure between the pump and the division valve at a predetermined amount in excess of the critical pressure of steam. When the division valve is fully open, the predetermined pressure will also be extended to the turbine control valve.

The method of operation of the installation illustrated in FIG. 1 and according to a first embodiment of the invention is as follows. Control of the output of the high pressure turbine between the ranges of 85%–100% of rated output is achieved by varying the opening of the turbine control valve between a fully open position (100% rated output) and the partially open position (85% rated output).

In order to vary output of the turbine within the ranges of approximately 65% and 85% of rated output, the turbine control valve is partially opened to a predetermined position and the division valve is kept fully open. Pressure within the steam generator and at the turbine control valve is then varied by varying the delivery pressure of the feed water pump such that the pressure at the control valve will vary between the predetermined amount in excess of the critical pressure down to a point slightly in excess of the critical pressure.

Alternatively, the turbine control valves are kept fully open for outputs in the range of approximately 85%–100% and the pressure at the control valve is varied as described immediately above.

Control of turbine output below approximately 65% is achieved by varying the opening of the division valve. By partially closing the division valve, pressure to the partially open turbine control valve is reduced to subcritical values thus reducing pressure in the entry side of the high pressure turbine. The use of a division valve or valves assures that pressure within the steam generator will remain in excess of the critical pressure at all times thus preventing damage to the steam generator because of thermal stresses even though pressure in the superheater and steam line downstream of the valve may be subcritical.

A further method of operation of the installation illustrated in FIG. 1 according to a second embodiment of the invention is as follows. Control of the output of the high pressure turbine between the ranges of approximately 65%–100% of rated output is achieved by opening the turbine control valve to the fully opened position and varying the delivery pressure of the feed water pump such that the pressure at the control valve will vary between the predetermined amount in excess of critical pressure down to a point slightly in excess of the critical pressure while keeping the division valve fully open. Control of turbine output within the range of approximately 65%–0% of rated output is accomplished by varying the opening of the division valve from the fully open position to the closed position.

A still further method of operation of the installation of FIG. 1 according to a third embodiment of the invention is as follows. Control of the output of the turbine between 100% and approximately 85% of rated capacity involves keeping the control valve fully open, keeping the division valve fully open and varying the delivery of the feed water pump so as to vary the steam pressure between a predetermined amount in excess of critical pressure down to a point slightly in excess of critical pressure. Control of the output of the turbine between approximately 85% of rated output down to 0% involves varying the opening of the division valve from a fully open position at approximately 85% of turbine output to a fully closed position at 0% output.

A feature of all three methods of operation is that a part of the range of variation of turbine output is achieved by varying the rate of delivery of the feed water pump such that the steam pressures produced will vary between the predetermined amount in excess of the critical pressure and an amount slightly in excess of the critical pressure.

Figure 2:
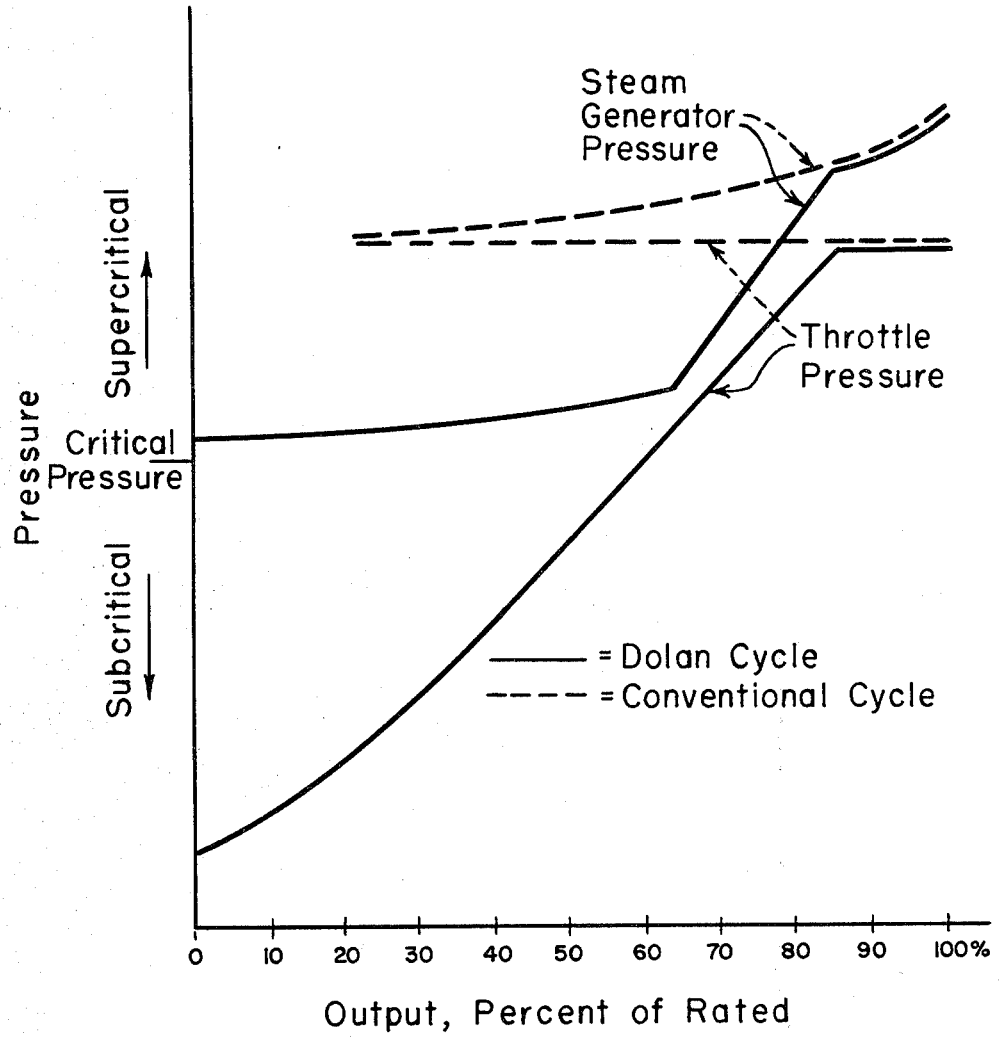
FIG. 2 is a graph illustrating change in throttle pressure at the turbine control valve as a function of turbine output when using an operating cycle according to the invention as compared with a conventional operating cycle.

Referring to FIG. 2, there is illustrated a graph depicting turbine output as a function of pressure utilizing a conventional control cycle as compared with the control cycle according to a first embodiment of the invention which for convenience is defined as the Dolan Cycle. The conventional control cycle referred to is one where the control valve is subjected to a constant pressure above the critical pressure and output is varied by regulating opening of the turbine control valve or valves. Control of turbine output in the 100%–85% range is the same as with the conventional cycle, namely by varying opening of the control valve with the result that throttle pressure for both cycles remains supercritical and the steam generator pressure is the same for both.

As shown in connection with the Dolan Cycle, turbine output is reduced from approximately 85% rated capacity to approximately 65% capacity by reducing throttle pressure from the normal full load pressure down to slightly above critical pressure. As explained previously, this is accomplished by varying the delivery pressure of the feed water pump so as to reduce the steam generator pressure. Turbine output is reduced below 65% by closing the division valve, which as shown, further reduces throttle pressure below the critical pressure but allows the steam generator pressure to remain slightly above critical pressure.

Figure 3:
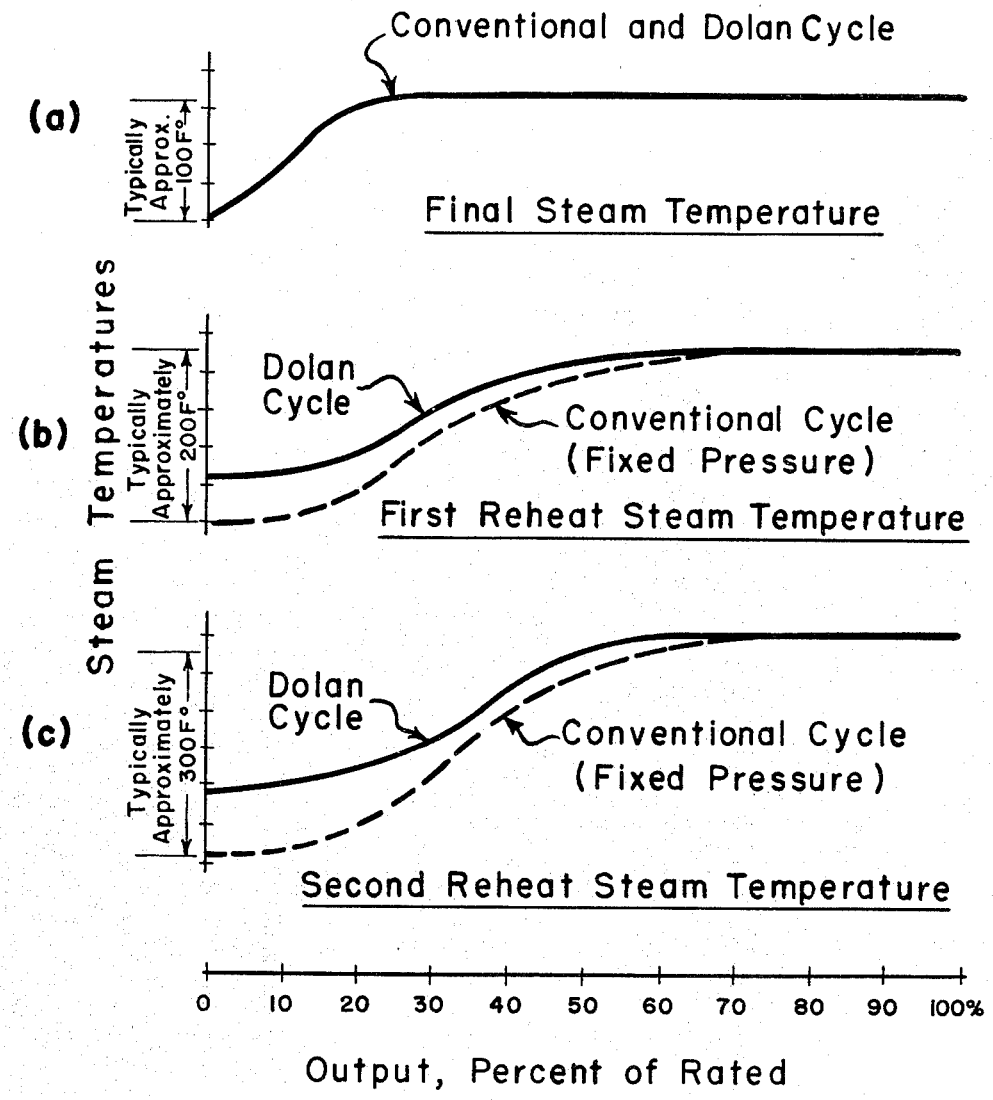
FIGS. 3*a*, 3*b* and 3*c* are graphs illustrating the principal steam temperatures as a function of turbine output in an installation of the type illustrated in FIG. 1 utilizing an operating cycle according to the invention as compared with a conventional operating cycle.
Figure 4:
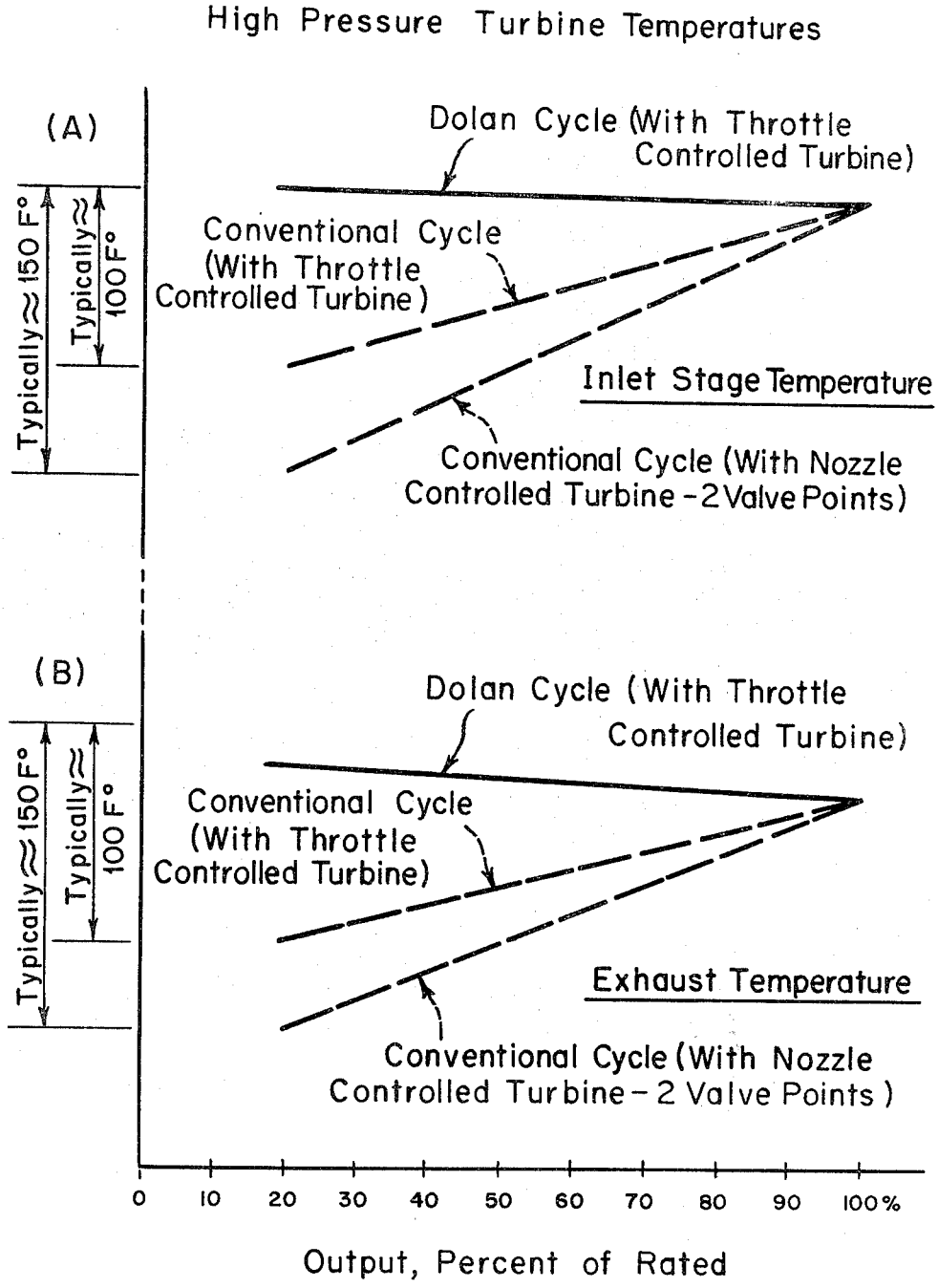
FIGS. 4*a* and 4*b* are graphs illustrating temperatures at the inlet and exhaust of the high pressure turbine as a function of turbine output in an installation of the type illustrated in FIG. 1 utilizing an operating cycle according to the invention as compared with a conventional operating cycle.

The advantage of the Dolan Cycle as compared with a conventional cycle is illustrated in FIGS. 3 and 4. While temperature changes of the Dolan Cycle as compared with a conventional cycle may appear insignificant in connection with the steam temperature entering the turbines under varying turbine outputs (FIGS. 3*a*, 3*b* and 3*c*), use of the Dolan Cycle results in less temperature change in the high pressure turbine over a wide load range than when using a conventional cycle as shown in FIGS. 4*a* and 4*b*. This is important because thermal stresses on the turbine are reduced.

The higher principal steam temperature over large load ranges improves the part load heat rate (thermal efficiency) of the installation.

Figure 5:
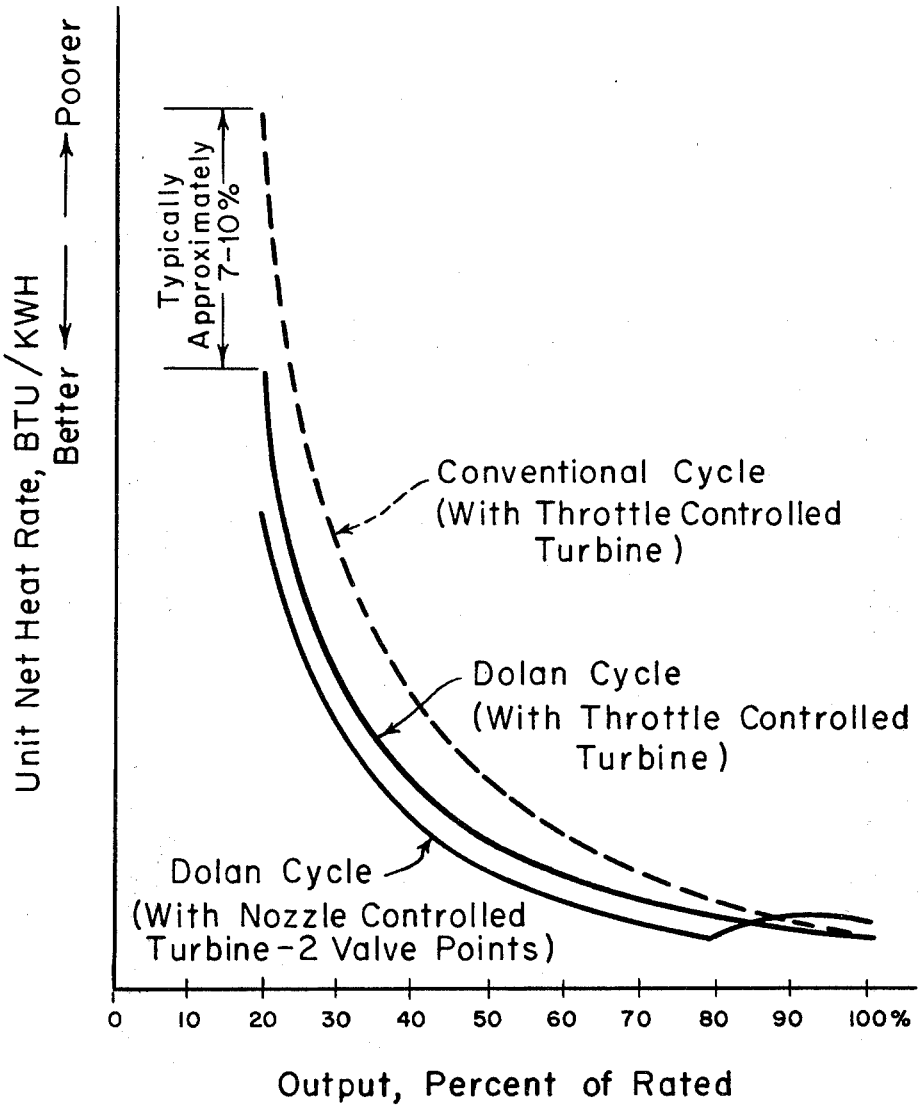
FIG. 5 is a graph illustrating unit net heat rate as a function of turbine output utilizing an operating cycle according to the invention as compared with conventional operating cycles.

Referring to FIG. 5, the increased efficiency of using the Dolan Cycle of operation according to the invention as compared with conventional operation cycles is illustrated. As shown, the Dolan Cycle, between the output ranges of 85% down to approximately 20%, has a better heat rate than the conventional cycle of a throttled controlled turbine utilizing constant pressure imparted onto a turbine control valve the opening of which is varied.

I claim:

1. A method of varying turbine output in an installation including a steam generator, a feed water pump for producing pressure in said generator to a predetermined amount in excess of the critical pressure of steam, a superheater, at least one controllable division valve positioned between said superheater and said steam generator for regulating the pressure of steam delivered from said steam generator to said superheater, a turbine receiving steam from said superheater and at least one turbine control valve for regulating entry of steam to said turbine; including the steps of setting a turbine control valve to a predetermined open position, maintaining said division valve in a fully open position, and varying the rate of delivery of said feed water pump to vary steam pressure in said steam generator between said predetermined amount in excess of said critical pressure and an amount slightly above said critical pressure whereby the steam pressure at said turbine throttle valve is varied between said amount slightly above said critical pressure and said predetermined amount in excess of said critical pressure.

2. A method of varying turbine output according to claim 1 between approximately 65% and 100% of rated output including the additional step of varying the rate of delivery of said feed water pump so that the pressure of steam produced in said generator at approximately 85% of rated output is at said predetermined amount in excess of the critical pressure and so that the pressure of steam produced in said generator at approximately 65% of rated output is at said amount slightly above said critical pressure and the additional step of varying the opening of said turbine control valve between said predetermined open position at approximately 85% of rated output and the fully open position at 100% rated output.

3. A method of varying turbine output according to claim 2 between approximately 0% and 65% of rated output including the additional step of varying the opening of said division valve between a fully open position at approximately 65% of rated output and a fully closed position at 0% of rated output.

4. A method of varying turbine output according to claim 1 between approximately 65% and 100% of rated output including the additional step of fully opening said turbine control valve and the additional step of varying the rate of delivery of said feed water pump so that the pressure of steam produced in said generator at approximately 65% of rated output is slightly in excess of the critical pressure and so that pressure produced in said generator at 100% of rated output is at said predetermined amount in excess of said critical pressure.

5. A method of varying turbine output according to claim 4 between approximately 0% and 65% of rated output including the additional step of varying the opening of said division valve between a fully open position at approximately 65% of rated output and a fully closed position at 0% of rated output.

6. A method of varying turbine output according to claim 1 between approximately 85% and 100% of rated output including the additional step of fully opening said turbine control valve and the additional step of varying the rate of delivery of said feed water pump so that the pressure of steam produced in said generator at approximately 85% of rated output is slightly in excess of the critical pressure and so that the pressure produced in said generator at 100% of rated output is at said predetermined amount in excess of said critical pressure.

7. A method of varying turbine output according to claim 6 between 0% and approximately 85% of rated output including the additional step of varying the opening of said division valve between a fully open position at approximately 85% of rated output and a fully closed position at 0% of rated output.

* * * * *